United States Patent [19]

Davis et al.

[11] Patent Number: 4,468,156

[45] Date of Patent: Aug. 28, 1984

[54] UNDERWATER STRUCTURE AND METHOD FOR ITS CONSTRUCTION

[75] Inventors: John B. Davis, Oakville; H. Glen Gilchrist, Calgary, both of Canada

[73] Assignee: Golder Associates Ltd., Mississauga, Canada

[21] Appl. No.: 358,896

[22] Filed: Mar. 17, 1982

[30] Foreign Application Priority Data

Dec. 2, 1981 [CA] Canada ..... 391361

[51] Int. Cl.[3] ..... E02D 15/06; E02D 29/06

[52] U.S. Cl. ..... 405/222; 405/223

[58] Field of Search ..... 405/11, 13, 217, 222, 405/223, 225

[56] References Cited

U.S. PATENT DOCUMENTS 1,584,203 5/1926 Upson ..... 405/222
2,101,358 12/1937 Boardman ..... 405/222
2,102,254 12/1937 Brockhurst ..... 405/222
3,893,304 7/1975 Huvale et al. ..... 405/223 X

FOREIGN PATENT DOCUMENTS 706493 12/1979 U.S.S.R. ..... 405/223

*Primary Examiner*—David H. Corbin
*Attorney, Agent, or Firm*—Ridout & Maybee

[57] ABSTRACT

The invention relates to a method of constructing a free standing structure in a body of water, comprising the steps of attaching an impervious membrane to a floating formwork, filling the membrane with water thereby expanding it, partially filling the expanded membrane with non-hardenable particulate material which settles to form a body within the expanded membrane resting on the bed of the body of water, removing water from the particulate body so that the body of water exerting a confining pressure on the particulate body renders it coherent, and filling a remaining upper portion of the expanded membrane with a material which hardens.

19 Claims, 8 Drawing Figures

10
11
12
13
14
16
17
18
19
21
22
25

UNDERWATER STRUCTURE AND METHOD FOR ITS CONSTRUCTION

This invention relates to improvements in the structure and method of construction of the invention described in Canadian Pat. No. 1,010,667 issued May 24, 1977, and in U.S. Pat. No. 4,009,580 issued Mar. 1, 1977, both assigned to Golder Hoeck and Associates Limited, a predecessor of the present applicant.

The invention described in the aforementioned patents relates to an underwater structure for use such as a breakwater or an island providing a work area above the water's surface. For use as an island, the structure comprises a floatable deck unit to which is attached a bag-like impervious membrane proportioned in accordance with the depth of water at the construction site. Upon positioning the empty membrane and deck unit at the desired site, the membrane is expanded by filling it with water. With the base portion of the membrane resting on the bed of the body of water, particulate material such as sand is introduced while water is simultaneously removed to provide a particulate body defined by the membrane. This body can be rendered coherent by virtue of the hydrostatic pressure of the surrounding water acting on the drained sand body to increase the internal shear strength of the body. Because at any depth below the surface of a body of water, the lateral pressure exerted by the drained sand is less than the confining hydrostatic pressure of the surrounding water, the structure of the invention is stable and able to support a large proportion of its own weight. The structure is thus suitable for use in off shore industrial activities such as oil drilling.

In contrast to the prior structures, the use of a prefabricated floating deck unit is not always needed. Such a unit may be reasonably expensive. Savings may be achieved by incorporating into the structure, during construction, a hard upper surface suitable for a work area or other purpose.

Additionally, the use of a mobile construction platform or barge incorporating a reuseable formwork to which the membrane is attached during the construction process will provide advantages over the previous method.

The improvements of the present invention are considered to be particularly useful in the formation of a breakwater comprising a number of structures acting cooperatively. Such structures preferably are assembled individually in accordance with the method of the present invention and then connected in a series to form a large structure. The same principle applies for the formation of a large island, wherein a group of structures according to the invention may be joined to form the larger entity. Additional uses for individual structures or combinations of structures will be apparent to those skilled in the art.

Accordingly, the present invention provides a method of constructing a free standing structure in a body of water, comprising the steps of attaching an impervious membrane having a base and side portions to a framework positioned at the construction site, filling the membrane with water thereby expanding it, partially filling the expanded membrane with non-hardenable particulate material which settles to form a body within the expanded membrane resting on the bed of the body of water, removing water from the particulate body so that the body of water exerting a confining pressure on the particulate body renders it coherent, and filling a remaining upper portion of the expanded membrane with a material which hardens.

The present invention also provides a free standing structure in a body of water comprising, an impervious membrane having a base and side portions, the base resting on the bed of the body of water, the membrane defining a volume containing a lower major layer of drained non-hardenable particulate material, an upper minor layer of hardened material, and means for maintaining the pore water pressure in the lower layer at a level sufficiently low to provide the structure with adequate strength to maintain the stability of the structure.

A preferred embodiment of the present invention will be described with reference to the accompanying drawings in which.

Figures 1, 2:
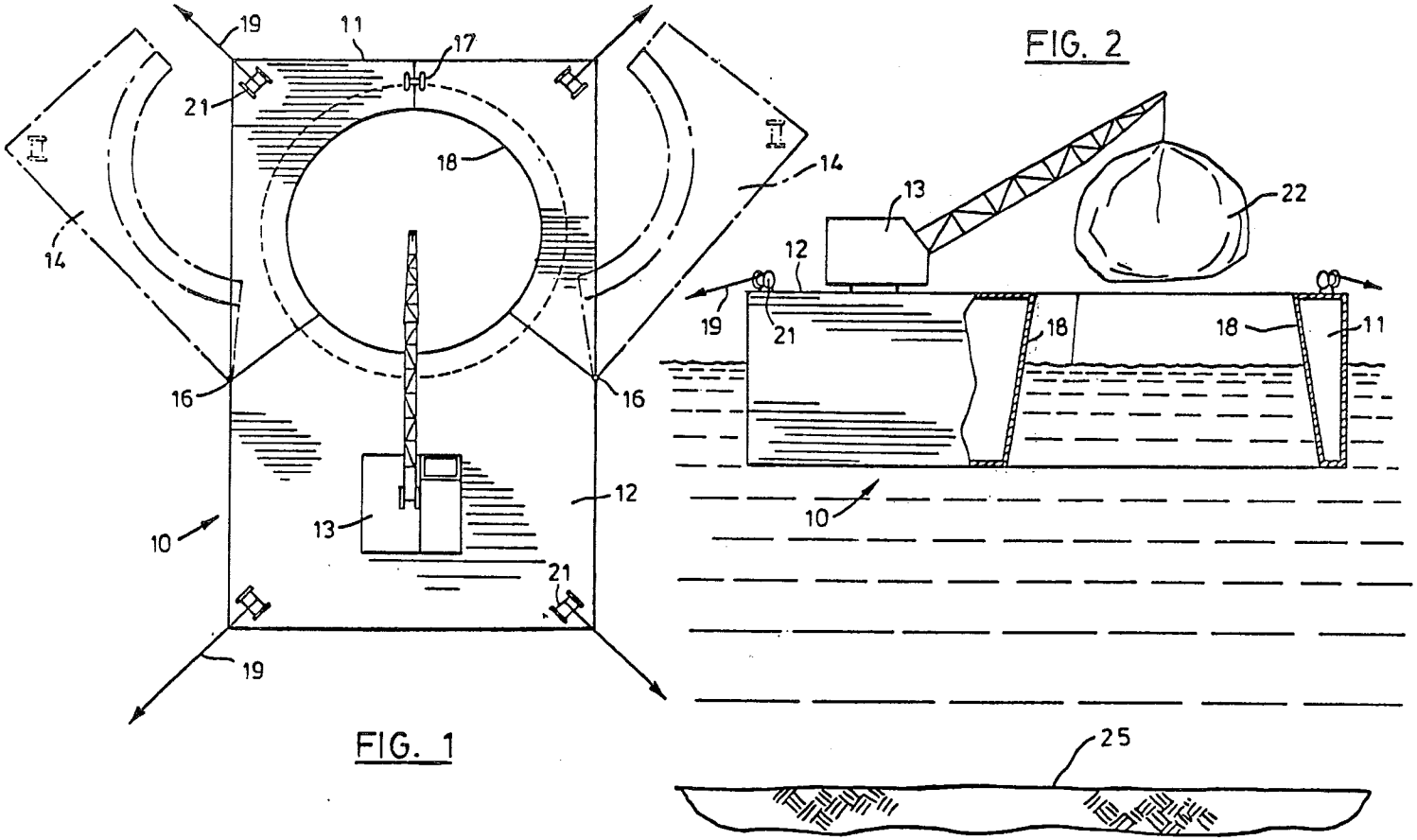
FIG. 1 is a plan view of a floating construction platform incorporating a reuseable formwork.
FIG. 2 is a vertical cross sectional view of the platform of FIG. 1 showing the initial stage of deployment of a membrane.

Referring to FIG. 1, a method of construction of a structure in accordance with the present invention comprises the use of a floating platform 10 incorporating a formwork 11. A preferred configuration of the platform 10 comprises a work area 12 suitable for accommodating a crane 13 or other necessary equipment (not shown). The formwork 11 has opposing wings 14 pivotally attached to the platform 10 at hinges 16. During construction of the desired structure, the wings 14 are joined by means of a clamp 17 to provide a form 18 (FIG. 2).

Figure 3:
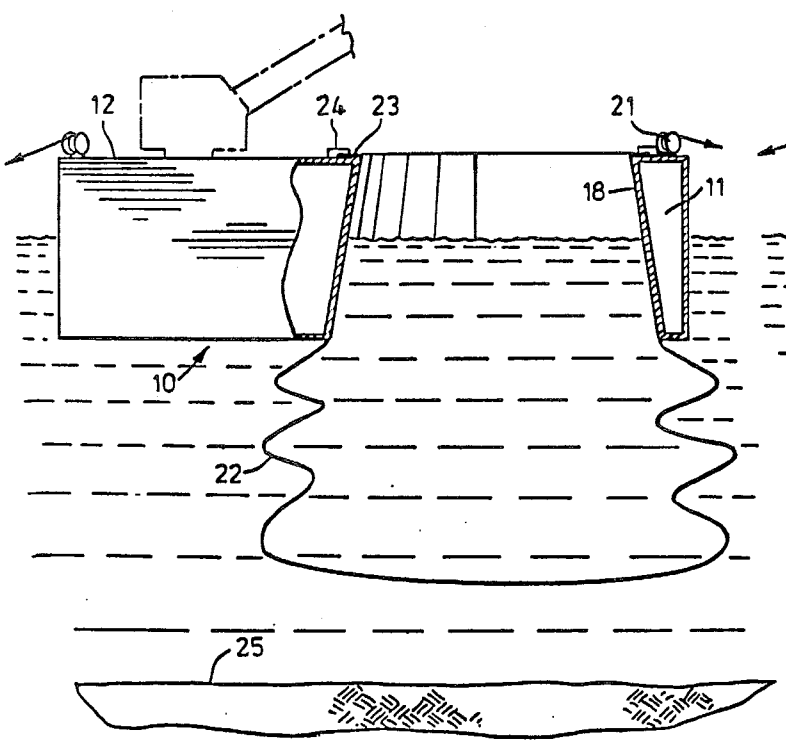
FIG. 3 is a vertical sectional view of the platform and membrane showing the membrane attached to the formwork and partially expanded.

The platform 10 is positioned at the construction site preferably by means of lines 19 anchored off its four corners and maintained taught by winches 21. The crane 13 is used to position an impervious membrane 22 in the form 18 with the upper edge 23 of the membrane 22 secured to the formwork 11 by clamps 24 (FIG. 3).

The membrane 22 may be fabricated of an impervious, flexible material such as high specification nylon fabric coated on both sides with abrasion resistant neoprene rubber. The dimensions of the membrane will depend on the depth of water at the site and the purpose for which the structure is to be used. The membrane 22 may initially be folded or bundled to facilitate its installation in the form 18 as shown in FIG. 2.

Figure 4:
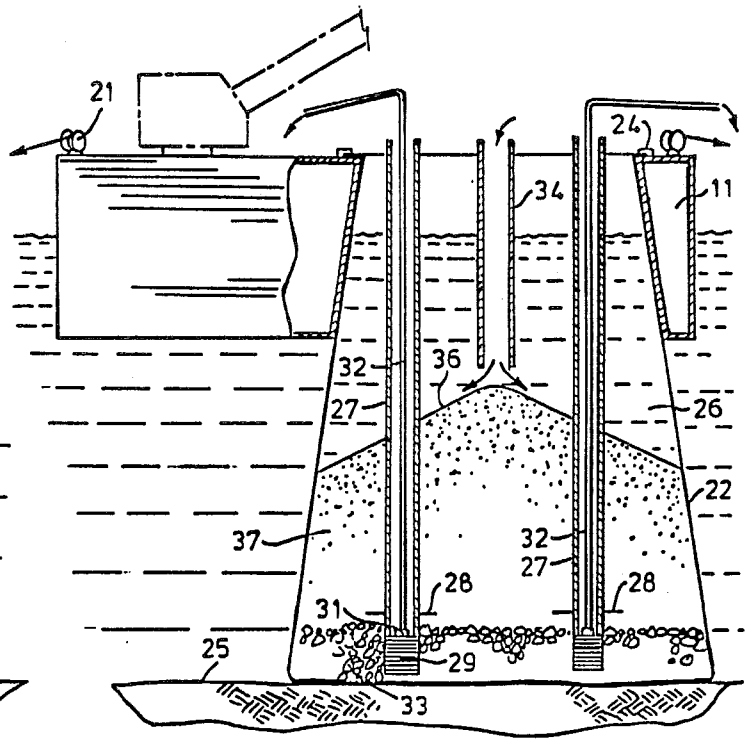
FIG. 4 is a vertical sectional view of the platform and membrane showing the membrane fully deployed and means for carrying out the preferred method of construction in accordance with the invention.

Deployment of the membrane 22 is accomplished by pumping water into it until it is fully expanded with its bottom portion resting on the bed 25 of the body of water, the membrane 22 defining a volume 26. Preferably, an initial layer of coarse particulate material is introduced into the volume 26 to provide ballast. At least one well casing 27 is then installed in the volume 26. It has been found that for the construction of an island in accordance with the invention, it is preferable to employ at least two well casings 27 as shown in FIG. 4. Each well casing 27 is provided with an anchor collar 28 to prevent hydrostatic uplifting of the casing 27 during subsequent dewatering operations. A well screen 29 is provided at the lower end of each casing 27, and a submersible pump 31 connected to the top of the platform 10 by a riser pipe 32 is positioned at the bottom opening of each well casing 27.

To the first layer of coarse ballast, additional coarse particulate material is introduced into the volume 26 to form a layer 33 suitable for providing a drainage medium wherein the pumps 31 can operate to dewater the fill subsequently added to the volume 26.

A slurry of water and non-hardenable particulate material, preferably sand, is pumped into the volume 26 through a pipe 34 which is raised as the level 36 of the fill rises. Simultaneously with this fill operation, water is removed from the settling particulate body 37 by means of the pumps 31.

As previously described in Canadian Pat. No. 1,010,667, an alternative filling procedure may be used comprising alternating layers of coarse and fine particulate material. Depending on the characteristics of the fill material used, this latter procedure may be preferable to provide efficient drainage of the particulate body formed.

Figure 5:
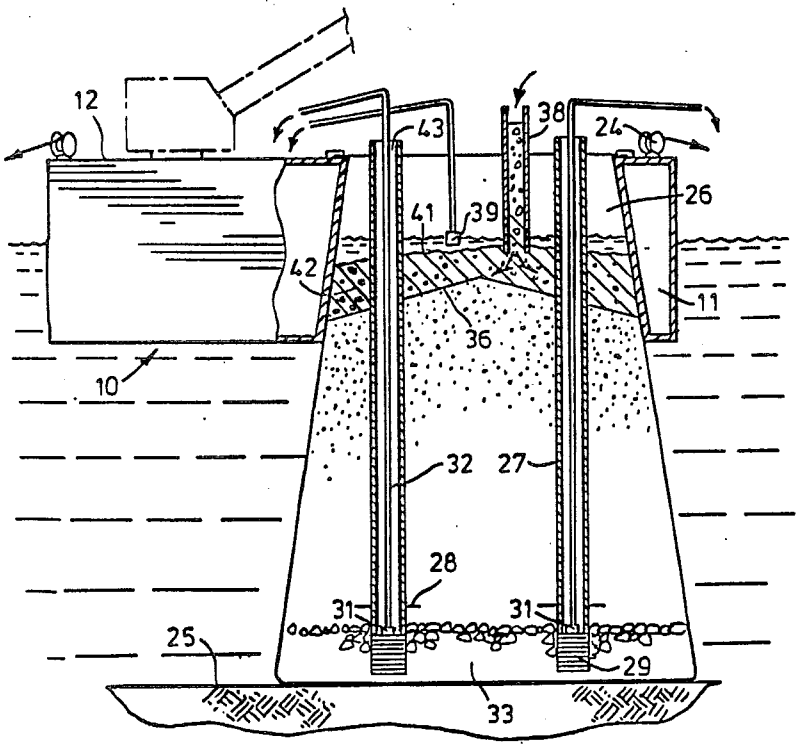
FIG. 5 is a view similar to FIG. 4 and additionally showing means for constructing an upper layer of hardenable material for the structure in accordance with the invention.

When the level 36 of the particulate body 37 has reached the desired height within the formwork 11 (FIG. 5) the filling of the non-hardenable particulate material is stopped and the introduction of a hardenable material, preferably sand to which a hardening agent such as cement has been added, is commenced. Preferably, the hardenable material is pumped into the volume 26 through a pipe 38 while simultaneous removal of the displaced water is achieved by means of one or more secondary pumps 39 located just above the rising level 41 of the hardenable material layer 42.

During and following the placement of the hardenable material layer 42, the submersible pumps 31 continue to operate in order to prevent the build up of pore water pressure within the body 37. The result is that the hydrostatic pressure of the surrounding body of water acts to confine the body 37 as defined by the membrane 22 and thereby to increase the internal shear strength of the body 37 so that it forms a coherent, self-supporting unit.

Figure 6:
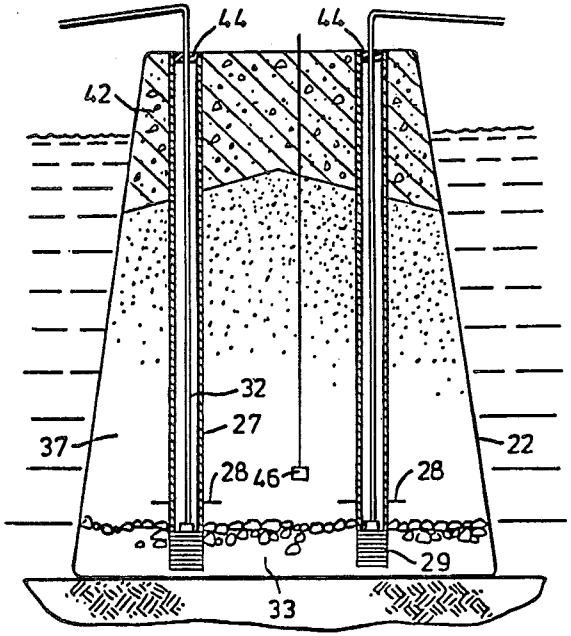
FIG. 6 is a vertical sectional view of the completed structure, the platform and formwork having been removed.

When the desired height of the level 41 is reached, filling of the hardenable material is stopped, and the upper layer 42 is allowed to set. The structure is then completed as shown in FIG. 6 by sealing each annulus 43 between the pump riser pipe 32 and the upper portion of each well casing 27 with a packer 44. The upper edge 23 of the membrane 22 is released from the clamps 24 and the top portion of the membrane 22 is folded over the upper surface of the hard layer 42 and sealed thereby fully enclosing the structure. The formwork 11 is removed by releasing the clamps 17 and pivoting the wings 14 at the hinges 16 away from the completed structure thereby allowing the floating platform 10 to be moved to another site for reuse.

Maintenance of the completed structure requires that the submersible pumps 31 continue to operate as needed to keep the pore water pressure in the body 37 at a low level. In this regard, one or more piezometers 46 are installed in the lower portion of the body 37 to monitor the pore water pressure.

Figure 7:
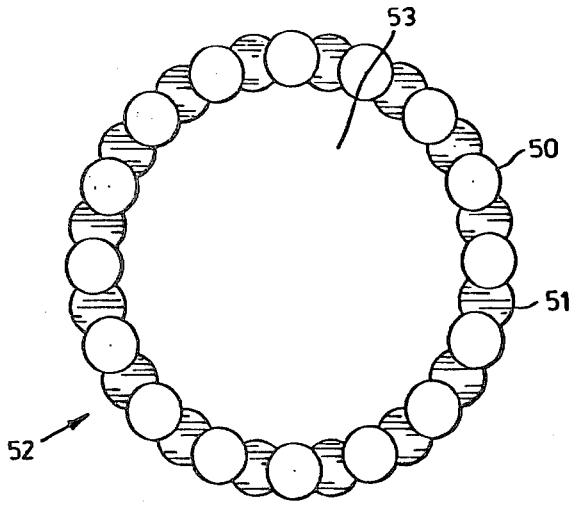
FIG. 7 is a plan view of a structure comprising a number of the individual structures of the invention joined together.
Figure 8:
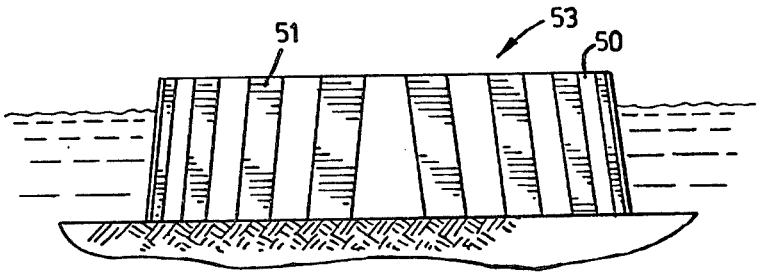
FIG. 8 is a side view of the structure of FIG. 7.

As mentioned above, the structure of the invention is particularly suitable for use as a unit in a group of similar structures joined together to form, for example, a breakwater or large artificial island. An example by way of illustration of such an application of the structure of the invention joined together to form a large artificial island is shown in FIGS. 7 and 8.

In this embodiment, structures of the invention are constructed as described previously to form a ring of primary cells 50 and the spaces between these primary cells 50 are subsequently infilled with secondary cells 51 constructed according to the invention but fabricated of a suitable shape to meet with and match the walls of the primary cells 50. A ring structure 52 formed in this manner may be filled with conventional hydraulic fill to provide a large island 53.

Similarly, a linear arrangement of structures of the invention may be joined to form a breakwater, and other configurations of individual structures or combinations of structures will be apparent to those skilled in the art.

What we claim is:

1. A method of constructing a free standing structure in a body of water, said structure having an impervious outer membrane defining a volume containing a lower major layer of drained non-hardenable particulate material and an upper minor layer of hardened material, comprising the steps of attaching an impervious membrane having a base and side portions to a floating formwork positioned at a construction site, filling the membrane with water thereby expanding it to define a volume and causing the base portion to rest on the bed of the body of water, partially filling the volume at least to the bottom of the formwork with non-hardenable particulate material which settles to form a body within the volume while simultaneously removing water from the settled particulate body so that the body of water exerting a confining pressure on the particulate body renders it coherent, filling the remaining portion of the volume within the formwork with hardenable material while simultaneously removing additional water from the underlying settled particulate body, sealing the hardened top of the structure, and removing the formwork.

2. A method as claimed in claim 1, wherein the membrane is releasably secured to the formwork.

3. A method as claimed in claim 1, wherein a first layer of ballast is introduced into the expanded membrane volume.

4. A method as claimed in claim 3, wherein the ballast is coarse particulate material.

5. A method as claimed in claim 1, wherein the non-hardenable particulate material is sand introduced into the volume in a water slurry.

6. A method as claimed in claim 1, wherein one or more submersible pumps are positioned inside the volume near the bottom thereof for use in the removal of water from the settled particulate body.

7. A method as claimed in claim 6, wherein each such pump is located at the bottom of a well casing.

8. The method as claimed in claim 1, wherein the hardenable material is a mixture of sand and cement.

9. The method as claimed in claim 1, wherein one or more secondary pumps are positioned just above the rising level of hardenable material for use in the removal of water displaced by the inflowing hardenable material.

10. The method as claimed in claim 1, wherein the top of the structure is sealed in part by folding a surplus upper membrane portion over the top surface of the hardened material.

11. The method as claimed in claim 10, wherein the sealing of the top of the structure includes the step of sealing an annulus defined at the top of each well casing.

12. A free standing structure in a body of water comprising, an impervious membrane having a base and side portions, the base resting on the bed of the body of water, the membrane defining a volume into which is introduced water and a non-hardenable particulate material from which sufficient water is removed to give a lower major layer of drained non-hardenable particulate material, the upper portion of said volume being then filled with a hardenable material to give an upper minor layer of hardened material, and means for maintaining the pore water pressure in the lower layer at a level sufficiently low to provide the structure with adequate internal shear strength to maintain the stability of the structure.

13. A structure as claimed in claim 12, wherein the lower layer comprises a minor initial layer of coarse particulate material providing an efficient drainage medium, upon which rests a major layer of fine particulate material.

14. A structure as claimed in claim 13, wherein the fine particulate material is sand.

15. A structure as claimed in claim 12, wherein the upper layer of hardened material is a mixture of sand and cement.

16. A structure as claimed in claim 12, wherein the means for maintaining the low pore water pressure comprises at least one submersible pump installed near the bottom of the volume.

17. A structure as claimed in claim 16, wherein the pore water pressure is monitored by at least one piezometer installed in the lower portion of the volume.

18. A structure as claimed in claim 12, wherein the top surface of the upper hardened layer is sealed.

19. A structure as claimed in claim 18, wherein an upper portion of the membrane is folded over the top hardened surface and sealed thereto.

* * * * *